US005524982A

United States Patent [19]

Kruse et al.

[11] Patent Number: 5,524,982

[45] Date of Patent: Jun. 11, 1996

[54] PLANETARY CENTRIFUGAL MIXING APPARATUS HAVING EXCHANGEABLE CENTRIFUGAL MIXING BLADES

[75] Inventors: Ernst O. Kruse, Gottmadingen/Randegg, Germany; Christian Renner, Beringen, Switzerland

[73] Assignee: Georg Fischer Giessereianlagen AG, Schaffhausen, Switzerland

[21] Appl. No.: 384,037

[22] Filed: Feb. 6, 1995

[30] Foreign Application Priority Data

Feb. 8, 1994 [CH] Switzerland ..... 00 355/94

[51] Int. Cl.[6] ..... B01F 7/30; B28C 5/16

[52] U.S. Cl. ..... 366/66; 366/288; 366/331; 403/340

[58] Field of Search ..... 366/64–67, 287–288, 366/297–301, 325, 331, 342, 343; 403/294, 339, 340

[56] References Cited

U.S. PATENT DOCUMENTS

| | | | |
|---|---|---|---|
| 581,917 | 5/1897 | Munz | 403/339 X |
| 633,124 | 9/1899 | Cummer | 366/66 |
| 770,855 | 9/1904 | Hetherington | 366/66 |
| 888,199 | 5/1908 | Stafford | 366/67 |
| 1,331,776 | 2/1920 | Lewis | 403/339 X |
| 1,365,363 | 1/1921 | Adams | 403/340 X |
| 1,514,652 | 11/1924 | Burmaster | 403/340 |
| 1,524,854 | 2/1925 | Browne | 366/67 |
| 1,555,964 | 10/1925 | Guedel | 366/66 |
| 1,687,660 | 10/1928 | Cummer | 366/66 |
| 1,712,549 | 5/1929 | Castellano et al. | 366/65 X |
| 1,741,013 | 12/1929 | Cummer | 366/66 |
| 2,259,456 | 10/1941 | Crawford | 403/339 X |
| 2,540,346 | 2/1951 | Potter | 403/340 |
| 3,387,829 | 6/1968 | Nangoh et al. | 366/64 X |
| 4,304,494 | 12/1981 | Lutz | 366/64 X |
| 5,302,020 | 4/1994 | Kruse | 366/288 |
| 5,358,328 | 10/1994 | Inoue et al. | 366/65 |

FOREIGN PATENT DOCUMENTS

| | | | |
|---|---|---|---|
| 1394436 | 5/1975 | United Kingdom | 366/66 |

*Primary Examiner*—Charles E. Cooley
*Attorney, Agent, or Firm*—Bachman & LaPointe

[57] ABSTRACT

An apparatus for mixing molding sand which comprises a mixing vessel having a mixing tool disposed within the mixing vessel, the mixing tool comprises an elongated shaft having a plurality of blades arranged along the elongated shaft wherein each of the plurality of blades comprises two opposed identical blade portions fitted to each other by a form fitting connection at a location adjacent the elongated shaft. The form fitting connection includes a groove and a lug on each of the opposed blade portions wherein the lug on one of the opposed blade portions engages the groove on the other opposed blade portion. The groove and lug form in part a peripheral surface of a polygonal recess on the form fitting connection which surface abuts the elongated shaft of the mixing tool when the opposed blade portions are secured to the shaft.

9 Claims, 3 Drawing Sheets

PLANETARY CENTRIFUGAL MIXING APPARATUS HAVING EXCHANGEABLE CENTRIFUGAL MIXING BLADES

BACKGROUND OF THE INVENTION

The present invention relates to an apparatus for mixing and preparing fluid materials, in particular, molding sand, within a cylindrical mixing vessel by means of a centrifugal mixing tool.

An apparatus for mixing and preparing fluid materials as aforesaid is disclosed in U.S. Pat. No. 5,302,020 which is assigned to the assignee of the present invention, the '020 patent is incorporated herein by reference. The apparatus disclosed in the '020 patent includes a centrifugal shaft having a plurality of centrifugal blades. The centrifugal blades are exposed to varying degrees of wear during the mixing of the fluid materials. Naturally, it would be highly desirable to provide a mixing tool having a plurality of centrifugal blades wherein either the entire blade or any number thereof may be exchanged when excessive wear occurs.

Accordingly, it is the principal object of the present invention to provide an apparatus for mixing and preparing fluid materials wherein any number of centrifugal blades provided on a mixing tool may be replaced without requirement of the dismantling of other blades on the shaft of the mixing tool.

Further objects and advantages of the present invention will appear hereinbelow.

SUMMARY OF THE INVENTION

In accordance with the present invention the foregoing objects and advantages readily obtained by providing an apparatus for mixing molding sand which comprises a mixing vessel having a mixing tool disposed within the mixing vessel, the mixing tool comprises an elongated shaft having a plurality of blades arranged along the elongated shaft wherein each of the plurality of blades comprises two opposed blade portions fitted to each other at a location adjacent the elongated shaft. In accordance with the present invention, each of the opposed blade portions includes a connecting mechanism for fixing the opposed blade portions to the elongated shaft for rotation therewith as well as fixing each opposed blade to each other. In the preferred embodiment of the present invention, the connecting mechanism includes a groove and lug arrangement extending traversely to the longitudinal axis of the shaft on each of the opposed blade portions wherein the lug of each of the opposed blade portions engages in the groove of the other of the opposed blade portions.

By providing an arrangement as aforesaid, the individual blade portions may be exchanged without dismantling all of the plurality of blades from the shaft of the mixing tool.

DETAILED DESCRIPTION

Figure 1:
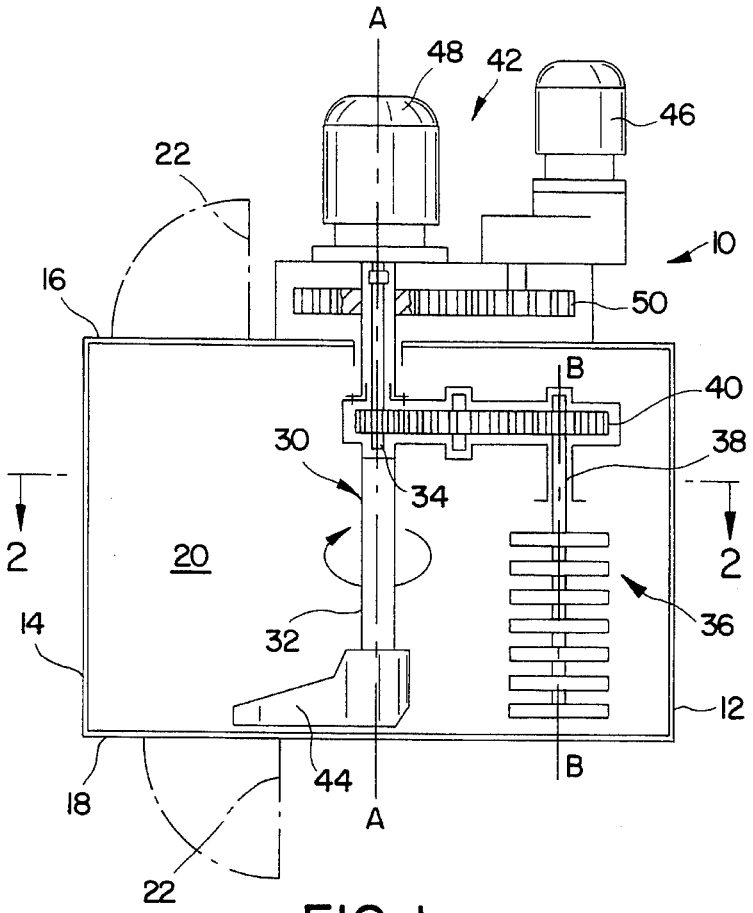
FIG. 1 PRIOR ART
FIGS. 1 and 2 are partial cross-sectional views of the prior art mixing device of U.S. Pat. No. 5,302,020 which may employ the mixing tool of the present invention.
Figure 2:
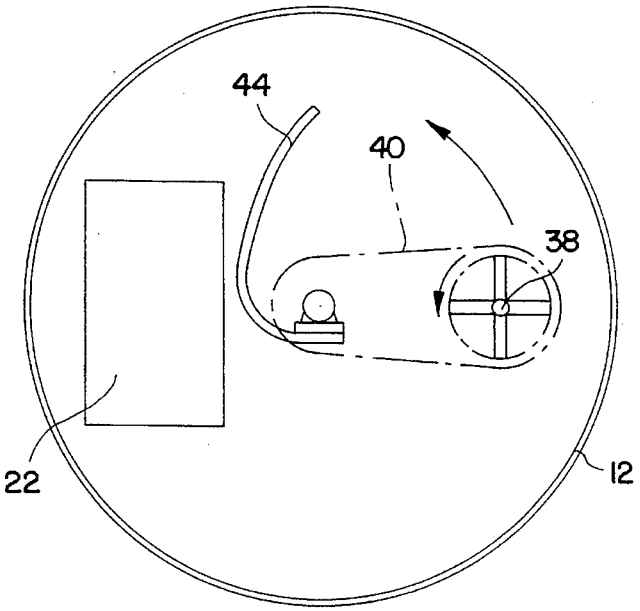
FIG. 2 PRIOR ART

With reference to FIGS. 1 and 2, the apparatus of U.S. Pat. No. 5,302,020 for which the mixing tool of the present invention is particularly suited is described.

The mixing device 10 comprises a mixing vessel 12 having a substantially cylindrical sidewall 14 which extends about a central axis (A). The vessel 12 further includes a top cover 16 and a bottom base 18 which define with sidewall 14 a mixing chamber 20. Cover 16 and base 18 may be provided with access doors 22 for feeding and removing molding sand to the mixing vessel 12. Drive means 30 is rotatably mounted in mixing chamber 20 about axis (A) and comprises first and second concentric 10 drive shafts, 32 and 34, respectively. A first mixer 36 is located radially of the drive means 30 and extends on centrifugal shaft 38 about axis (B) which lies substantially parallel to axis (A). Centrifugal shaft 38 is coupled to the second drive shaft 34 by a gear coupling 40, shown schematically, for rotating the mixer 36 about axis (B). The mixer 36 is also fixed to the first drive shaft 32 such that the mixer orbits (revolves) about axis (A) when drive shaft 32 is rotated by motor means 42 described below. A mixing plow 44 is connected to drive shaft 32 for rotation therewith about axis (A). As schematically shown in FIGS. 1 and 2, the drive means 42 comprises first and second drive motor 46 and 48, respectively. Motor 46 is coupled to first drive shaft 32 by coupling means, preferably a gear coupling, shown schematically at 50. Motor 48 is connected to second drive shaft 34 for driving centrifugal shaft 38 via coupling 40. It should be appreciated that a single motor may be employed with suitable coupling as the drive means 42. The operation of the device will now be described. Motor 48 drives shaft 34 which drives shaft 38 via coupling 40 for rotating the mixer 36 about axis (B). At the same time motor 46 drives shaft 32 via coupling 50 for orbiting mixer 36 about axis (A). Thus, mixer 36 orbits while rotating for effectively mixing the molding sand as shown in FIG. 2. In addition, mixing plow 44 connected to drive shaft 32 rotates about axis (A) while mixer 36 orbits about axis (A). In accordance with the present invention, mixer 36 rotates at a rotational speed of between 200 to 1,000 rpm while orbiting at a rotational speed of between 20 to 200 rpm.

With reference FIGS. 3–6, the mixing tool of the present invention for use in the mixing device of FIGS. 1 and 2 will be described in detail.

Figure 4:
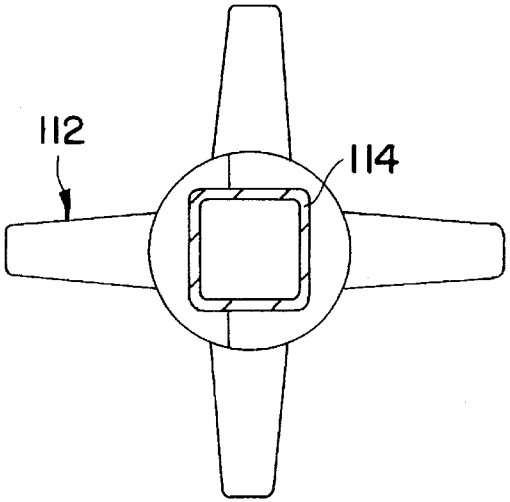
FIG. 4 is a section along line 4—4 of FIG. 3.
Figure 3:
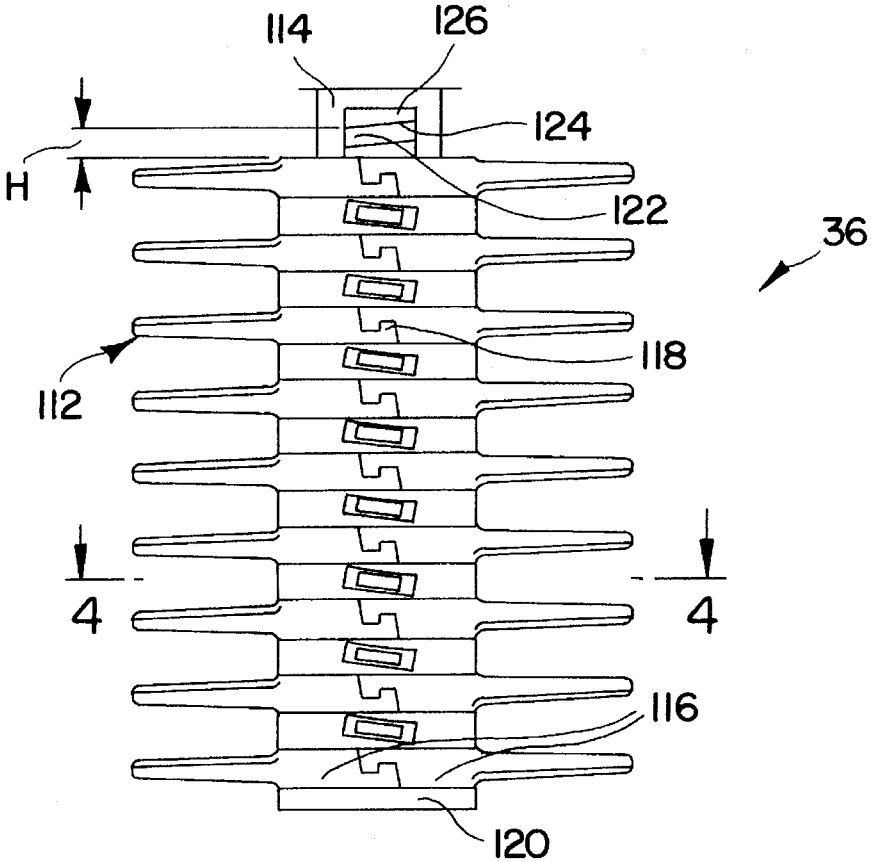
FIG. 3 is an enlarged view of the mixing tool in accordance with the present invention.

With reference to FIGS. 3 and 4, the mixing tool 36 has a plurality of centrifugal blades 112 fitted on a shaft 114 and fixed to the shaft for rotation therewith in a manner to be described hereinbelow. Each of the centrifugal blades 112 comprises two identical blade portions 116 which are joined together on the shaft 114 by means of a form-fitting connection 118. In accordance with the present invention each of the blade portions 116 is made of a material which is sufficiently elastic to be resistant to possible shocks. At the same time, the working surfaces of the blade portions 116 may be provided with a wear resistant surface portion in any manner known in the art.

Figure 5:
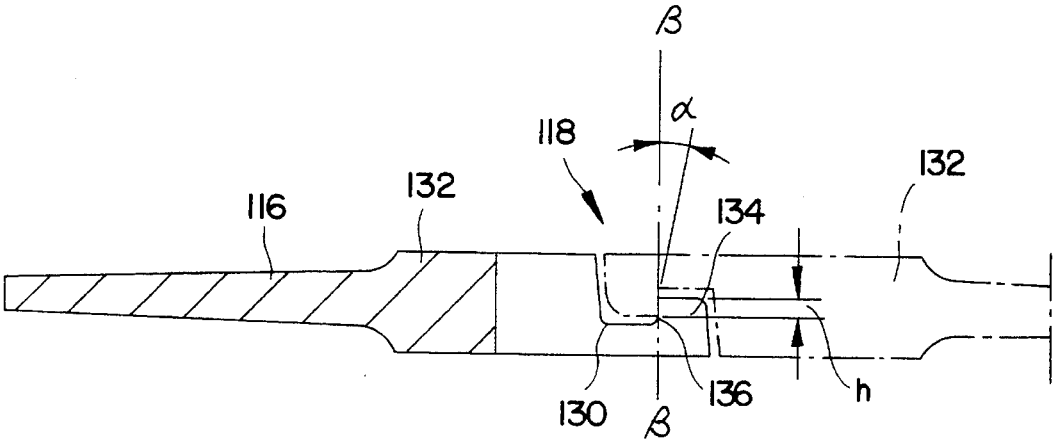
FIG. 5 is a section through a blade portion of the mixing tool of FIG. 3.
Figure 6:
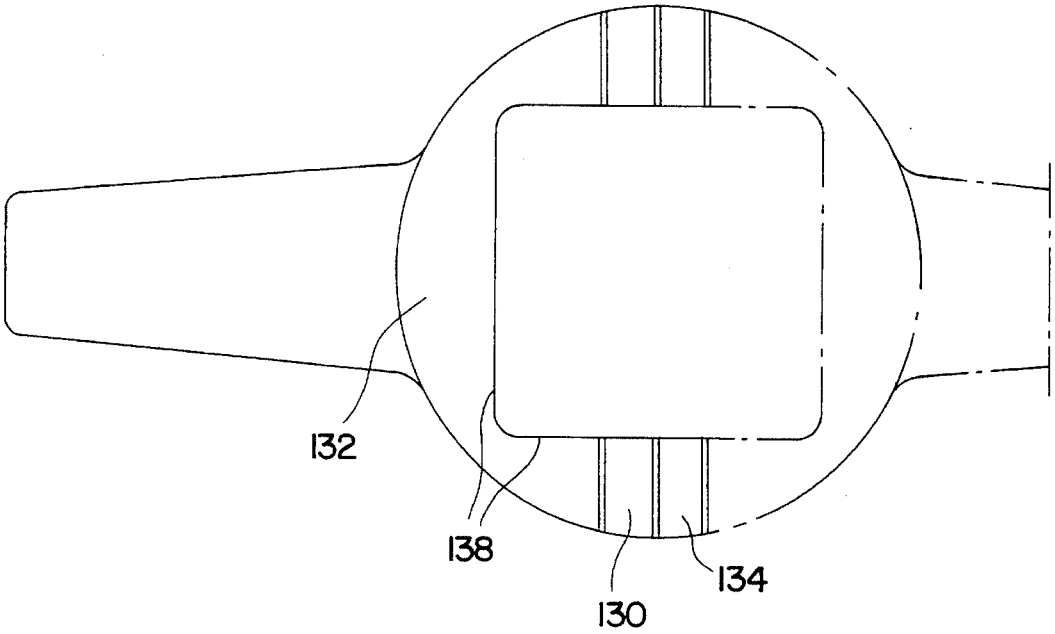
FIG. 6 is a plane view of the blade portion of FIG. 5.

With reference to FIGS. 5 and 6, the form fitting connection 118 for joining the individual blade portions 116 to the shaft 114 and to each other will be described. In accordance with a preferred embodiment of the present invention the shaft 114 is of rectangular cross section, preferably square in cross section, and is formed of a hollow tubular member.

The individual blade portions 116 are arranged alternately crossed wise on the shaft 114 and stacked thereon as shown in FIG. 3 by interlocking the form fitting connections 118 provided on each of the blade portions 116. The resulting structure is a plurality of centrifugal blades 112 alternately disposed at 90° angles relative to each other on the shaft 114. The centrifugal blades 112 are braced against a collar 120 on the end of the shaft 114 by means of one or more wedges 122 arranged on the sides of the shaft 114. The wedges 122 are supported with an incline surface 124 on a stop portion 126 fixedly connected to the shaft 114.

Referring now to FIGS. 5 and 6 each blade portion 116 is provided with a form fitting connection 118 for connection to an opposed blade portion 116. The form fitting connection 118 comprises a groove 130 extending on a hub portion 132. The groove 130 extends traversely to the axis B of that shaft 114. The hub 132 is also provided with a lug 134 extending traversely to the axis of the shaft 114. When mounted on the shaft 114, the opposed blades 116 are connected by the lug 134 of one of the opposed blades being received in the groove 130 of the other of the opposed blades. A surface 136 formed between the groove 130 and the lug 134 forms a stop surface for abutting the blade portions 116 against each other. The surface 136 extends in a plane passing through the shaft axis B or, alternately, preferably at an acute angle $\alpha$ to the shaft axis B. By providing an acute angle $\alpha$, the assembly and dismantling of the opposed blade portions 116 is simplified. Hub portion 132 of each opposed blade portion 116 is provided is provided with a polygonal recess 138 which forms with the polygonal recess 138 in the opposed blade portion 116 an aperture corresponding to the cross section of the shaft 114 thereby insuring a fixed connection of the centrifugal blade 112 to the shaft 114 and also making it possible for all the blade portions 116 to be of identical construction. The lugs of the opposed blade portions 116 received in the corresponding grooves 130 overlap by a height h which is smaller than the height H shown in FIG. 3. The height H being the free space between the uppermost centrifugal blade 112 and the stop portion 126 when the wedge or wedges 15 is/are removed. Thus, the centrifugal blades 112 can be lifted and one or several of the centrifugal blade portions 113 can be exchanged and replaced by inserting new blade portions 116. The centrifugal blades 112 can be lifted from the bottom, top or middle of the stack thereby allowing for a simple and fast exchange of the centrifugal blades 112 when wear is exhibited.

The described construction of the mixing tool having easily exchangeable, two-part centrifugal blades can be used with all devices for mixing, preparing and regenerating fluid materials, in particular foundry sands, which have a rotating mixing tool. It can also be used in particular with appropriate devices with rotating vertical, inclined or horizontal drums, the mixing tool being fixed in the drum or movable about an eccentric axis.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

We claim:

1. An apparatus for mixing molding sand so as to prepare a fluid molding sand mixture comprises a mixing vessel and first mixing means disposed within said mixing vessel, said first mixing means comprises an elongated shaft about a longitudinal axis B and a plurality of blades arranged along said longitudinal shaft, each of said plurality of blades comprises two overlapping opposed blade portions having connecting means for fixing said opposed blade portions to said elongated shaft for rotation therewith and to each other, said connecting means includes a groove, a lug extending traversely to said longitudinal axis B wherein the lug of each of said opposed blade portions engages in the groove of the other of said opposed blade portions, and said opposed blade portions defining a polygonal recess for receiving said elongated shaft wherein the groove and lug form in part a peripheral surface of the polygonal recess which surface abuts said elongated shaft.

2. An apparatus according to claim 1 wherein said elongated shaft is rectangular in cross-section.

3. An apparatus according to claim 2 wherein said elongated shaft is square in cross-section.

4. An apparatus according to claim 1 wherein said two opposed blade portions are braced against a collar on said elongated shaft by wedge means provided on said elongated shaft.

5. An apparatus according to claim 1 wherein said blades are arranged alternately along said elongated shaft at a right angle to an adjacent blade.

6. An apparatus according to claim 1 further comprises:

said mixing vessel having an elongated sidewall portion extending about an axis (A);

drive means disposed about said axis (A);

said first mixing means located radially of said drive means about said axis (B) substantially parallel to said axis (A);

coupling means located between said drive means and said first mixing means for drivingly connecting said drive means to said first mixing means;

motor means for driving said drive means for orbiting said first mixing means about said axis (A) as said first mixing means rotates about said axis (B);

said drive means includes a first drive shaft connected to said coupling means for orbiting said first mixing means about said axis (A) and a second drive shaft concentric with said first drive shaft and connected to said coupling means for rotating said first mixing means about said axis (B);

second mixing means fixed to said first drive shaft wherein said second mixing means rotates about said axis (A) as said first mixing means orbits about said axis (A); and said coupling means includes a first gear unit positioned between said motor means and said first drive shaft and a second gear unit positioned between said second drive shaft and said elongated shaft of said first mixing means for rotating said first mixing means about said axis (B).

7. An apparatus according to claim 6 wherein said motor means includes a first motor connected to said first drive shaft by said first gear unit and a second motor connected to said second drive shaft.

8. An apparatus according to claim 7 wherein said drive means rotates said first mixing means about said axis (B) at a rotational speed of about 200 to 1,000 rpm and orbits said first mixing means about said axis (A) at a rotational speed of about 20 to 200 rpm.

9. An apparatus according to claim 1 wherein each of said opposed blade portions is of identical construction.

* * * * *